US007165940B2

(12) United States Patent
McGrath et al.

(10) Patent No.: US 7,165,940 B2
(45) Date of Patent: Jan. 23, 2007

(54) METHOD AND APPARATUS FOR COOLING GAS TURBINE ROTOR BLADES

(75) Inventors: Edward Lee McGrath, Easley, SC (US); Benjamin A. Lagrange, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/865,471

(22) Filed: Jun. 10, 2004

(65) Prior Publication Data

US 2005/0276697 A1 Dec. 15, 2005

(51) Int. Cl.
*F01D 5/18* (2006.01)

(52) U.S. Cl. ..... 416/1; 416/97 R

(58) Field of Classification Search ..... 415/1, 415/115, 116; 416/1, 96 R, 96 A, 97 R
See application file for complete search history.

(56) References Cited

U.S. PATENT DOCUMENTS 4,303,374 A 12/1981 Braddy
4,601,638 A 7/1986 Hill et al.
4,664,597 A 5/1987 Auxier et al.
5,176,499 A * 1/1993 Damlis et al. ..... 416/97 R
5,503,527 A 4/1996 Lee et al.
5,503,529 A 4/1996 Anselmi et al.
6,106,231 A * 8/2000 Brainch et al. ..... 416/97 R
6,174,135 B1 1/2001 Lee
6,267,552 B1 7/2001 Weigand
6,851,924 B2 * 2/2005 Mazzola et al. ..... 415/115

FOREIGN PATENT DOCUMENTS

SU 1615396 A1 * 12/1990 ..... 416/97 R

* cited by examiner

*Primary Examiner*—Christopher Verdier
(74) *Attorney, Agent, or Firm*—Armstrong Teasdale LLP

(57) ABSTRACT

An airfoil for a gas turbine includes a leading edge, a trailing edge a tip plate, a first sidewall extending in radial span between an airfoil root and the tip plate, and a second sidewall connected to the first sidewall at the leading edge and the trailing edges, to define a cooling cavity therein. The sidewall extends in radial span between the airfoil root and the tip plate. The airfoil also includes a plurality of longitudinally spaced apart trailing edge cooling slots arranged in a column extending through the first sidewall. The slots are in flow communication with the cooling cavity and arranged in a non-uniform distribution along the trailing edge so that the number of slots in at least one portion of the trailing edge is greater than a different portion of the trailing edge.

20 Claims, 3 Drawing Sheets

METHOD AND APPARATUS FOR COOLING GAS TURBINE ROTOR BLADES

BACKGROUND OF THE INVENTION

This invention relates generally to gas turbine engines and more particularly, to methods and apparatus for cooling gas turbine engine rotor assemblies.

At least some known rotor assemblies include at least one row of circumferentially-spaced rotor blades. Each rotor blade includes an airfoil that includes a pressure side, and a suction side connected together at leading and trailing edges. Each airfoil extends radially outward from a rotor blade platform. Each rotor blade also includes a dovetail that extends radially inward from a shank extending between the platform and the dovetail. The dovetail is used to mount the rotor blade within the rotor assembly to a rotor disk or spool. Known blades are hollow such that an internal cooling cavity is defined at least partially by the airfoil, platform, shank, and dovetail.

During operation, portions of the airfoil of the blades are exposed to higher temperatures than other portions of the blades. Over time, such temperature differences and thermal strain may induce thermal stresses in the blade. Such thermal strains may induce thermal deformations to the airfoil, for example, local creep deflection, and may cause other problems such as airfoil low-cycle fatigue, which may shorten the useful life of the rotor blade.

To facilitate reducing the effects of high temperatures within at least some known rotor blades, at least some of the rotor blade airfoils include a trailing edge slot and a cut back pressure-side wall with the slot divided into evenly spaced channels which discharge a film of cooling air over the exposed back surface of the airfoil. However, because of temperature differences at different points along the trailing edge, the air from the evenly spaced slots does not cool the trailing edge enough to remove the temperature differential between different points along the trailing edge of the airfoil.

BRIEF DESCRIPTION OF THE INVENTION

In one aspect, an airfoil for a gas turbine is provided. The airfoil includes a leading edge, a trailing edge, a tip plate, a first sidewall extending in radial span between an airfoil root and the tip plate, and a second sidewall connected to the first sidewall at the leading edge and the trailing edge to define a cooling cavity therein. The sidewall extends in radial span between the airfoil root and the tip plate. The airfoil also includes a plurality of longitudinally spaced apart trailing edge cooling slots arranged in a column extending through the first sidewall. The slots are in flow communication with the cooling cavity and arranged in a non-uniform distribution along the trailing edge so that the number of slots in at least one portion of the trailing edge is greater than a different portion of the trailing edge.

In another aspect, a turbine blade is provided. The turbine blade includes a platform, a dovetail, a shank connected to the platform and the dovetail, and an airfoil comprising a leading edge, a trailing edge, a pressure sidewall, and a suction sidewall. The airfoil is connected to the platform. The turbine blade also includes at least one cooling cavity between the pressure sidewall and the suction sidewall, and a plurality of longitudinally spaced apart trailing edge cooling slots extending along the trailing edge. The trailing edge cooling slots are in flow communication with the cooling cavity and are arranged in a non-uniform distribution along the trailing edge so that the number of trailing edge cooling slots in at least one portion of the trailing edge is greater than a different portion of the trailing edge.

In another aspect, a rotor assembly for a gas turbine is provided. The rotor assembly includes a rotor shaft and a plurality of circumferentially-spaced rotor blades coupled to the rotor shaft. Each rotor blade includes a platform, a dovetail, a shank connected to the platform and the dovetail, and an airfoil comprising a leading edge, a trailing edge, a pressure sidewall, and a suction sidewall. The airfoil is connected to the platform. The turbine blade also includes at least one cooling cavity between the pressure sidewall and the suction sidewall, and a plurality of longitudinally spaced apart trailing edge cooling slots extending along the trailing edge. The trailing edge cooling slots are in flow communication with the cooling cavity and are arranged in a non-uniform distribution along the trailing edge so that the number of trailing edge cooling slots in at least one portion of the trailing edge is greater than a different portion of the trailing edge.

In another aspect, a method of cooling a trailing edge of a rotor blade airfoil is provided. The airfoil includes a leading edge, a trailing edge, a pressure sidewall and a suction sidewall, at least one cooling cavity between the pressure sidewall and the suction sidewall, and a plurality of longitudinally spaced apart trailing edge cooling slots extending along the trailing edge. The trailing edge cooling slots are in flow communication with the cooling cavity and arranged in a non-uniform distribution along the trailing edge so that the number of trailing edge cooling slots in at least one portion of the trailing edge is greater than a different portion of the trailing edge. The method includes providing cooling air to the cooling cavity, and directing a portion of the cooling air through the plurality of cooling slots.

DETAILED DESCRIPTION OF THE INVENTION

An airfoil for a gas turbine rotor blade that includes a plurality of longitudinally spaced apart trailing edge cooling slots arranged in a column is described in detail below. The cooling slots are arranged in a non-uniform distribution along the trailing edge so that the number of slots in at least one portion of the trailing edge is greater than a different portion of the trailing edge. The non-uniform cooling slot distribution permits the cooling air to be directed to the portions of the trailing edge that are exposed to the hottest external temperatures to improve the cooling of these areas. The improved cooling of the trailing edge alleviates possible local creep, possible oxidation and possible low-cycle fatigue of the airfoil.

Figure 1:
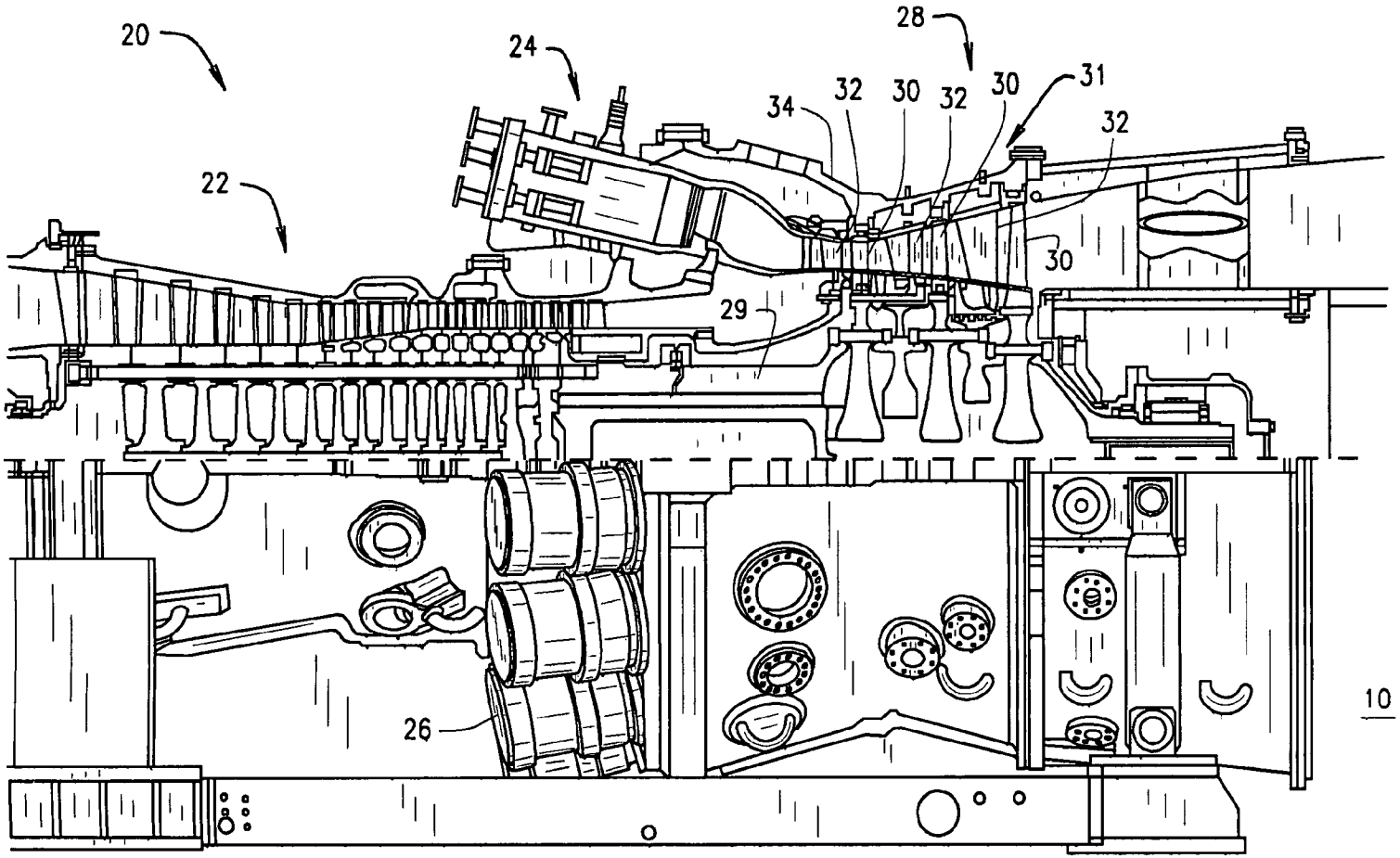
FIG. 1 is a side cutaway view of a gas turbine system that includes a gas turbine.

Referring to the drawings, FIG. 1 is a side cutaway view of a gas turbine system 10 that includes a gas turbine 20. Gas turbine 20 includes a compressor section 22, a combustor section 24 including a plurality of combustor cans 26, and a turbine section 28 coupled to compressor section 22 using a shaft 29. A plurality of turbine blades 30 are connected to turbine shaft 29. Between turbine blades 30 there is positioned a plurality of nonrotating turbine nozzle stages 31 that include a plurality of turbine nozzles 32. Turbine nozzles 32 are connected to a housing or shell 34 surrounding turbine blades 30 and nozzles 32. Hot gases are directed through nozzles 32 to impact blades 30 causing blades 30 to rotate along with turbine shaft 29.

In operation, ambient air is channeled into compressor section 22 where the ambient air is compressed to a pressure greater than the ambient air. The compressed air is then channeled into combustor section 24 where the compressed air and a fuel are combined to produce a relatively high-pressure, high-velocity gas. Turbine section 28 is configured to extract the energy from the high-pressure, high-velocity gas flowing from combustor section 24. Gas turbine system 10 is typically controlled, via various control parameters, from an automated and/or electronic control system (not shown) that is attached to gas turbine system 10.

Figure 2:
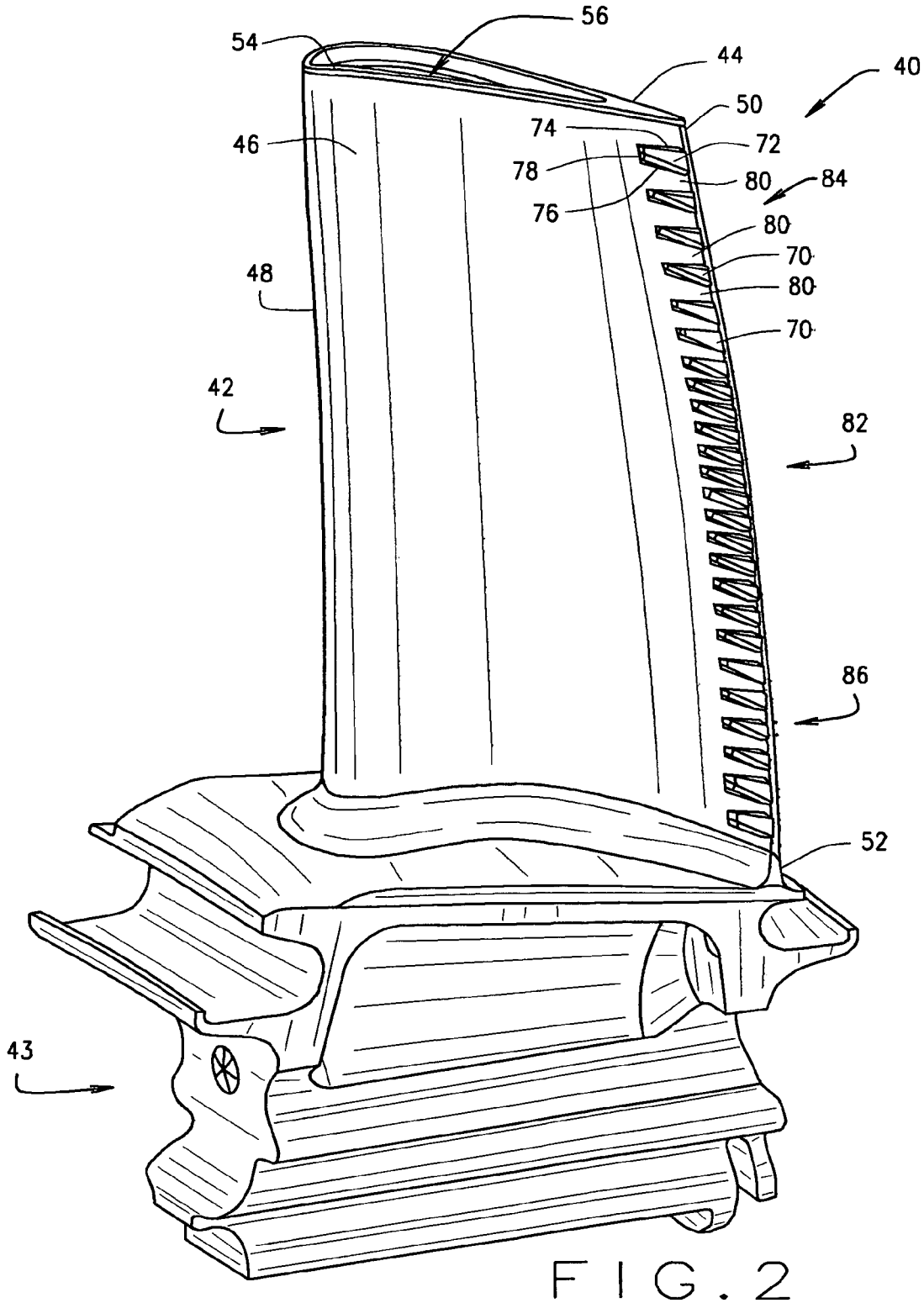
FIG. 2 is a perspective schematic illustration of a rotor blade shown in FIG. 1.
Figure 3:
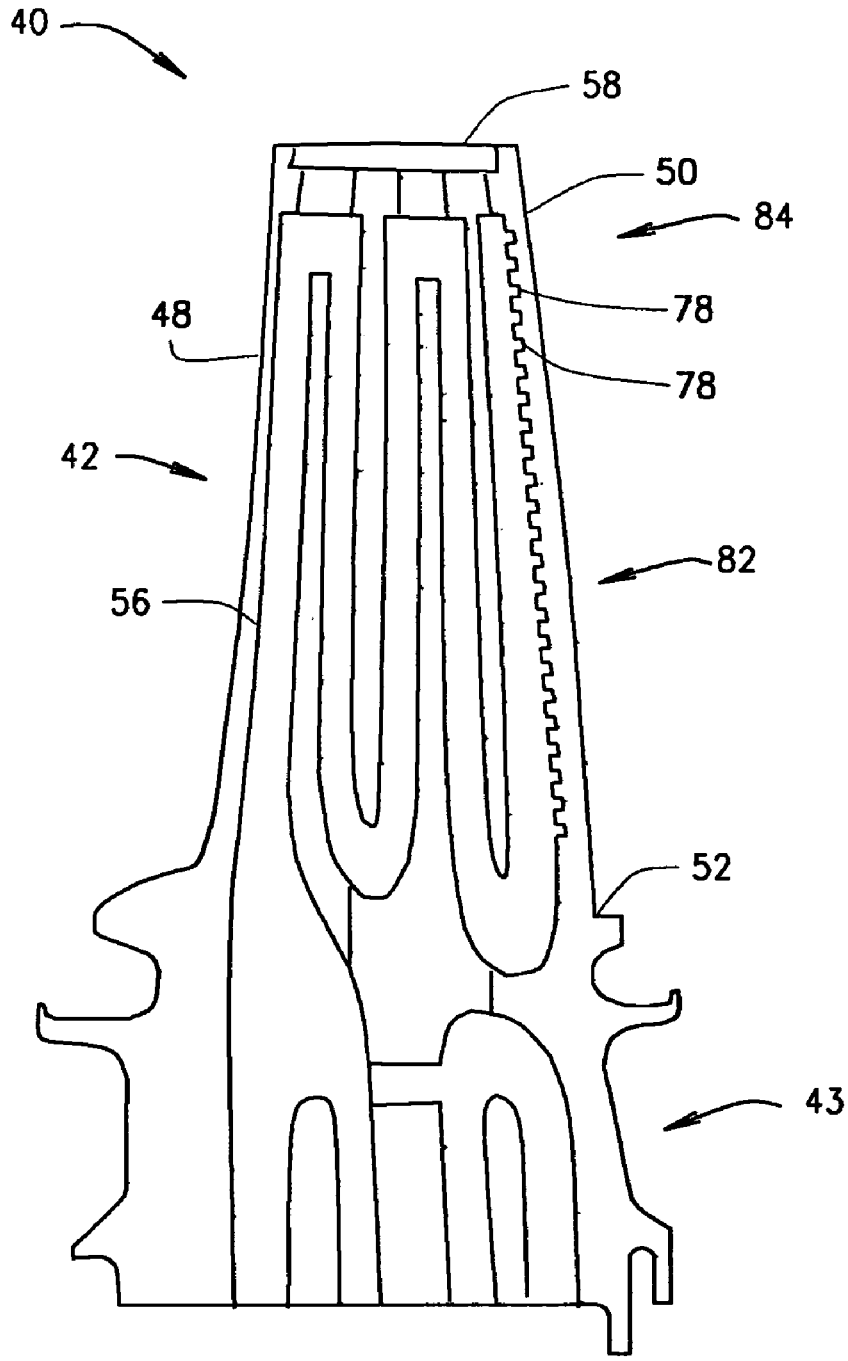
FIG. 3 is an internal schematic illustration of the rotor blade shown in FIG. 2.

FIG. 2 is a perspective schematic illustration of a rotor blade 40 that may be used with gas turbine engine 20 (shown in FIG. 1). FIG. 3 is an internal schematic illustration of rotor blade 40. Referring to FIGS. 2 and 3, in an exemplary embodiment, a plurality of rotor blades 40 form a high pressure turbine rotor blade stage (not shown) of gas turbine engine 20. Each rotor blade 40 includes a hollow airfoil 42 and an integral dovetail 43 used for mounting airfoil 42 to a rotor disk (not shown) in a known manner.

Airfoil 42 includes a first sidewall 44 and a second sidewall 46. First sidewall 44 is convex and defines a suction side of airfoil 42, and second sidewall 46 is concave and defines a pressure side of airfoil 42. Sidewalls 44 and 46 are connected at a leading edge 48 and at an axially-spaced trailing edge 50 of airfoil 42 that is downstream from leading edge 48.

First and second sidewalls 44 and 46, respectively, extend longitudinally or radially outward to span from a blade root 52 positioned adjacent dovetail 43 to a tip plate 54 which defines a radially outer boundary of an internal cooling chamber 56. Cooling chamber 56 is defined within airfoil 42 between sidewalls 44 and 46. Internal cooling of airfoils 42 is known in the art. In the exemplary embodiment, cooling chamber 56 includes a serpentine passage 58 cooled with compressor bleed air.

Cooling cavity 56 is in flow communication with a plurality of trailing edge slots 70 which extend longitudinally (axially) along trailing edge 50. Particularly, trailing edge slots 70 extend along pressure side wall 46 to trailing edge 50. Each trailing edge slot 70 includes a recessed wall 72 separated from pressure side wall 46 by a first sidewall 74 and a second sidewall 76. A cooling cavity exit opening 78 extends from cooling cavity 56 to each trailing edge slot 70 adjacent recessed wall 72. Each recessed wall 72 extends from trailing edge 50 to cooling cavity exit opening 78. A plurality of lands 80 separate each trailing edge slot 70 from an adjacent trailing edge slot 70. Sidewalls 74 and 76 extend from lands 80.

Trailing edge slots 70 are arranged in a non-uniform distribution along trailing edge 50 so that the number of slots 70 in a first portion 82 of trailing edge 50 is greater than a second portion 84 of trailing edge 50. Particularly, a distance between trailing edge cooling slots 70 located in first portion 82 of trailing edge 50 is different than a distance between trailing edge slots 70 cooling located in second portion 84 of trailing edge 50. Specifically, the number of trailing edge cooling slots 70 per inch of first portion 82 of trailing edge 50 is greater than the number of trailing edge cooling slots 70 per inch of second portion 84 of trailing edge 50. Also, the number of trailing edge slots 70 in first portion 82 of trailing edge 50 is greater than the number of trailing edge cooling slots 70 in a third portion 86 of trailing edge 50. The exemplary embodiment of airfoil 42 shown in FIGS. 2 and 3 includes three portions of trailing edge 50 having different numbers of cooling slots 70. In alternate embodiments, airfoil 42 can include two or more portions of trailing edge 50 providing a non-uniform distribution of cooling slots along trailing edge 50.

The non-uniform cooling slot distribution permits the cooling air to be directed to the portions of trailing edge 50 that are exposed to the hottest external temperatures to improve the cooling of these areas. The improved cooling of trailing edge 50 alleviate possible local creep, possible oxidation and possible low-cycle fatigue of the airfoil.

While the invention has been described in terms of various specific embodiments, those skilled in the art will recognize that the invention can be practiced with modification within the spirit and scope of the claims.

What is claimed is:

1. An airfoil for a gas turbine, said airfoil comprising:

a leading edge;

a trailing edge;

a tip plate;

a first sidewall extending in radial span between an airfoil root and said tip plate;

a second sidewall connected to said first sidewall at said leading edge and said trailing edge to define a cooling cavity between said first sidewall and said second sidewall, said second sidewall extending in radial span between the airfoil root and said tip plate;

a plurality of longitudinally spaced apart trailing edge cooling slots arranged in a column extending through said first sidewall, said slots in flow communication with said cooling cavity and arranged in a non-uniform distribution along said trailing edge so that a number of slots per inch in at least one portion of said trailing edge is greater than a number of slots per inch in a different portion of said trailing edge, wherein each portion includes a plurality of slots.

2. An airfoil in accordance with claim 1 further comprising:

a first distance between adjacent trailing edge cooling slots located in a first portion of said trailing edge;

a second distance between adjacent trailing edge cooling slots located in a second portion of said trailing edge, said first distance different than said second distance.

3. An airfoil in accordance with claim 1 wherein said trailing edge comprises a plurality of portions, each said portion comprising a number of trailing edge cooling slots per inch located therein, the number of trailing edge cooling slots per inch in a selected portion is different than the number of trailing edge cooling slots per inch in an adjacent portion.

4. An airfoil in accordance with claim 3 wherein said trailing edge comprises:

a first portion comprising a first number of trailing edge cooling slots per inch;

a second portion comprising a second number of trailing edge cooling slots per inch; and a third portion comprising a third number of trailing edge cooling slots per inch, said third portion extending from said airfoil root to said first portion, said first portion extending from said third portion to said second portion, said second portion extending from said first portion to said tip plate;

said first number of trailing edge cooling slots per inch is greater than said second and said third number of trailing edge cooling slots per inch.

5. An airfoil in accordance with claim 1 wherein said trailing edge comprises:

a first trailing edge cooling slot;

a second trailing edge cooling slot adjacent said first trailing edge slot;

a third trailing edge cooling slot adjacent said second trailing edge slot;

a first distance between said first and second trailing edge cooling slots;

a second distance between said second and third trailing edge cooling slots, said first distance different from said second distance.

6. A turbine blade comprising:

a platform;

a dovetail;

a shank connected to said platform and said dovetail;

an airfoil comprising a leading edge, a trailing edge, a pressure sidewall, and a suction sidewall, said airfoil connected to said platform;

at least one cooling cavity between said pressure sidewall and said suction sidewall; and a plurality of longitudinally spaced apart trailing edge cooling slots extending through said pressure sidewall along said trailing edge, said trailing edge cooling slots in flow communication with said cooling cavity and arranged in a non-uniform distribution along said trailing edge so that a number of trailing edge cooling slots per inch in at least one portion of said trailing edge is greater than a number of trailing edge slots per inch of a different portion of said trailing edge, wherein each portion includes a plurality of slots.

7. A turbine blade in accordance with claim 6 wherein said airfoil further comprises:

a first distance between adjacent trailing edge cooling slots located in a first portion of said trailing edge;

a second distance between adjacent trailing edge slots cooling located in a second portion of said trailing edge, said first distance different than said second distance.

8. A turbine blade in accordance with claim 6 wherein said airfoil trailing edge comprises a plurality of portions, each said portion comprising a number of trailing edge cooling slots per inch located therein, the number of trailing edge cooling slots per inch in a selected portion is different than the number of trailing edge cooling slots per inch in an adjacent portion.

9. A turbine blade in accordance with claim 8 wherein said airfoil trailing edge comprises:

a first portion comprising a first number of trailing edge cooling slots per inch;

a second portion comprising a second number of trailing edge cooling slots per inch; and a third portion comprising a third number of trailing edge cooling slots per inch, said third portion extending from said airfoil root to said first portion, said first portion extending from said third portion to said second portion, said second portion extending from said first portion to a tip plate;

said first number of trailing edge cooling slots per inch is greater than said second and said third number of trailing edge cooling slots per inch.

10. A turbine blade in accordance with claim 6 wherein said airfoil trailing edge comprises:

a first trailing edge cooling slot;

a second trailing edge cooling slot adjacent said first trailing edge slot;

a third trailing edge cooling slot adjacent said second trailing edge slot;

a first distance between said first and second trailing edge cooling slots;

a second distance between said second and third trailing edge cooling slots, said first distance different from said second distance.

11. A rotor assembly for a gas turbine, said rotor assembly comprising:

a rotor shaft; and a plurality of circumferentially-spaced rotor blades coupled to said rotor shaft, each said rotor blade comprising:

a platform;

a dovetail;

a shank connected to said platform and said dovetail;

an airfoil comprising a leading edge, a trailing edge, a pressure sidewall, and a suction sidewall, said airfoil connected to said platform;

at least one cooling cavity between said pressure sidewall and said suction sidewall; and a plurality of longitudinally spaced apart trailing edge cooling slots extending through said pressure sidewall along said trailing edge, said trailing edge cooling slots in flow communication with said cooling cavity and arranged in a non-uniform distribution along said trailing edge so that a number of trailing edge cooling slots per inch in at least one portion of said trailing edge is greater than a number of cooling slots per inch in a different portion of said trailing edge, wherein each portion includes a plurality of slots.

12. A rotor assembly in accordance with claim 11 wherein said airfoil further comprises:

a first distance between adjacent trailing edge cooling slots located in a first portion of said trailing edge;

a second distance between adjacent trailing edge slots cooling located in a second portion of said trailing edge, said first distance different than said second distance.

13. A rotor assembly in accordance with claim 11 wherein said airfoil trailing edge comprises a plurality of portions, each said portion comprising a number of trailing edge cooling slots per inch located therein, the number of trailing edge cooling slots per inch in a selected portion is different than the number of trailing edge cooling slots per inch in an adjacent portion.

14. A rotor assembly in accordance with claim 13 wherein said airfoil trailing edge comprises:

a first portion comprising a first number of trailing edge cooling slots per inch;

a second portion comprising a second number of trailing edge cooling slots per inch; and a third portion comprising a third number of trailing edge cooling slots per inch, said third portion extending from said airfoil root to said first portion, said first portion extending from said third portion to said second portion, said second portion extending from said first portion to a tip plate;

said first number of trailing edge cooling slots per inch is greater than said second and said third number of trailing edge cooling slots per inch.

15. A rotor assembly in accordance with claim 11 wherein said airfoil trailing edge comprises:

a first trailing edge cooling slot;

a second trailing edge cooling slot adjacent said first trailing edge cooling slot;

a third trailing edge cooling slot adjacent said second trailing edge cooling slot;

a first distance between said first and second trailing edge cooling slots;

a second distance between said second and third trailing edge cooling slots, said first distance different from said second distance.

16. A method of cooling a trailing edge of a rotor blade airfoil, said method comprising:

providing the airfoil, wherein the airfoil comprises a leading edge, the trailing edge, a pressure sidewall, and a suction sidewall, at least one cooling cavity between the pressure sidewall and the suction sidewall, and a plurality of longitudinally spaced apart trailing edge cooling slots extending through the pressure sidewall along the trailing edge, the trailing edge cooling slots in flow communication with the cooling cavity and arranged in a non-uniform distribution along the trailing edge so that a number of trailing edge cooling slots per inch in at least one portion of the trailing edge is greater than a number of trailing edge cooling slots per inch in a different portion of the trailing edge, wherein each portion includes a plurality of slots;

providing cooling air to the cooling cavity; and directing a portion of the cooling air through the plurality of cooling slots.

17. A method in accordance with claim 16 wherein the airfoil further comprises:

a first distance between adjacent trailing edge cooling slots located in a first portion of the trailing edge;

a second distance between adjacent trailing edge slots cooling located in a second portion of the trailing edge, the first distance different than the second distance.

18. A method in accordance with claim 16 wherein the airfoil trailing edge comprises a plurality of portions, each portion comprising a number of trailing edge cooling slots per inch located therein, the number of trailing edge cooling slots per inch in a selected portion is different than the number of trailing edge cooling slots per inch in an adjacent portion.

19. A method in accordance with claim 18 wherein the airfoil trailing edge comprises:

a first portion comprising a first number of trailing edge cooling slots per inch;

a second portion comprising a second number of trailing edge cooling slots per inch; and a third portion comprising a third number of trailing edge cooling slots per inch, the third portion extending from an airfoil root to the first portion, the first portion extending from the third portion to said second portion, the second portion extending from the first portion to a tip plate;

the first number of trailing edge cooling slots per inch is greater than the second and said third number of trailing edge cooling slots per inch.

20. A method in accordance with claim 16 wherein the airfoil trailing edge comprises:

a first trailing edge cooling slot;

a second trailing edge cooling slot adjacent the first trailing edge cooling slot;

a third trailing edge cooling slot adjacent the second trailing edge cooling slot;

a first distance between the first and second trailing edge cooling slots;

a second distance between the second and third trailing edge cooling slots, the first distance different from the second distance.

* * * * *